US010316643B2

(12) United States Patent
Chen

(10) Patent No.: US 10,316,643 B2
(45) Date of Patent: Jun. 11, 2019

(54) HIGH RESOLUTION DISTRIBUTED TEMPERATURE SENSING FOR DOWNHOLE MONITORING

(71) Applicant: Jeff Chen, Pearland, TX (US)

(72) Inventor: Jeff Chen, Pearland, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 545 days.

(21) Appl. No.: 14/062,547

(22) Filed: Oct. 24, 2013

(65) Prior Publication Data

US 2015/0120194 A1 Apr. 30, 2015

(51) Int. Cl.

| | |
|---|---|
| ***E21B 47/06*** | (2012.01) |
| ***E21B 47/00*** | (2012.01) |
| ***E21B 47/12*** | (2012.01) |

(52) U.S. Cl.

CPC ..... *E21B 47/065* (2013.01); *E21B 47/00* (2013.01); *E21B 47/123* (2013.01)

(58) Field of Classification Search

CPC ..... E21B 47/00; E21B 47/065; E21B 47/123
See application file for complete search history.

(56) References Cited

U.S. PATENT DOCUMENTS

| | | | |
|---|---|---|---|
| 4,109,717 A | 8/1978 | Cooke, Jr. | |
| 4,832,121 A | 5/1989 | Anderson | |
| 5,431,227 A | 7/1995 | Montgomery et al. | |
| 6,618,677 B1 | 9/2003 | Brown | |
| 7,398,680 B2 | 7/2008 | Glasbergen et al. | |
| 7,580,797 B2 * | 8/2009 | Akram | E21B 47/06 166/227 |
| 7,668,411 B2 * | 2/2010 | Davies | G01M 11/3109 385/12 |

(Continued)

FOREIGN PATENT DOCUMENTS

WO 02066789 A1 8/2002

OTHER PUBLICATIONS

Coleman, T., A Novel Technique for Depth Discrete Flow Characterization: Fibre Optic Distributed Temperature Sensing within Boreholes Sealed with Flexible Underground Liners, Jan. 2013.*

(Continued)

*Primary Examiner* — Alexander Satanovsky
*Assistant Examiner* — Lina M Cordero
(74) *Attorney, Agent, or Firm* — Cantor Colburn LLP

(57) ABSTRACT

A method, system and computer-readable medium for obtaining a temperature profile of a wellbore is disclosed. Raw temperature data are obtained from the wellbore using a distributed temperature sensing system. The raw temperature data includes noise. A numerical decomposition is performed on the raw temperature data within a dynamic window in a measurement space of the raw temperature data to obtain decomposition terms of order of first order and higher. An adaptive filter is applied to the decomposition terms of first order and higher within the dynamic window to reduce noise from the decomposition terms of first order and higher. The filtered decomposition terms of first order and higher are used to obtain a temperature profile of the wellbore.

14 Claims, 7 Drawing Sheets

(56) References Cited

U.S. PATENT DOCUMENTS

| | | | | |
|---|---|---|---|---|
| 7,699,103 | B2 * | 4/2010 | Den Boer | E21B 19/002 166/242.2 |
| 8,646,968 | B2 * | 2/2014 | MacDougall | G01K 11/32 374/161 |
| 8,757,870 | B2 * | 6/2014 | Hall | G01K 15/00 356/43 |
| 9,708,867 | B2 * | 7/2017 | Lovell | E21B 17/206 |
| 2003/0236626 | A1 | 12/2003 | Schroeder et al. | |
| 2004/0129418 | A1 | 7/2004 | Jee et al. | |
| 2005/0149264 | A1 | 7/2005 | Tarvin et al. | |
| 2005/0263281 | A1 * | 12/2005 | Lovell | E21B 17/206 166/255.1 |
| 2006/0215971 | A1 | 9/2006 | Ramos | |
| 2007/0158064 | A1 | 7/2007 | Pribnow et al. | |
| 2008/0023196 | A1 | 1/2008 | Crawley et al. | |
| 2008/0110389 | A1 * | 5/2008 | Smith | B63B 21/66 114/312 |
| 2008/0232425 | A1 * | 9/2008 | Hall | G01K 11/32 374/1 |
| 2008/0264162 | A1 | 10/2008 | Glasbergen et al. | |
| 2008/0264163 | A1 * | 10/2008 | Glasbergen | E21B 47/065 73/152.12 |
| 2008/0314142 | A1 * | 12/2008 | Davies | E21B 47/042 73/295 |
| 2009/0173494 | A1 * | 7/2009 | Tarvin | E21B 47/065 166/250.15 |
| 2009/0216456 | A1 | 8/2009 | Poe, Jr. | |
| 2010/0006292 | A1 | 1/2010 | Boles et al. | |
| 2010/0025048 | A1 * | 2/2010 | Franzen | E21B 43/24 166/385 |
| 2010/0108311 | A1 | 5/2010 | Daussin et al. | |
| 2010/0128756 | A1 | 5/2010 | Lee et al. | |
| 2010/0163223 | A1 | 7/2010 | Brown | |
| 2010/0254650 | A1 | 10/2010 | Rambow | |
| 2011/0226469 | A1 | 9/2011 | Lovell et al. | |
| 2011/0231135 | A1 | 9/2011 | Suh et al. | |
| 2011/0308788 | A1 | 12/2011 | Ravi et al. | |
| 2012/0010846 | A1 | 1/2012 | Brian et al. | |
| 2012/0012308 | A1 | 1/2012 | Ziauddin et al. | |
| 2012/0016587 | A1 | 1/2012 | Sierra et al. | |
| 2012/0139746 | A1 | 6/2012 | Chen et al. | |
| 2013/0003777 | A1 * | 1/2013 | Jaaskelainen | E21B 47/123 374/1 |
| 2014/0025319 | A1 * | 1/2014 | Farhadiroushan | G01S 5/186 702/56 |
| 2014/0086009 | A1 * | 3/2014 | Yoneshima | G01V 1/48 367/31 |
| 2014/0157882 | A1 | 6/2014 | Molenaar | |

OTHER PUBLICATIONS

Briggs, Martin A. "Using high-resolution distributed temperature sensing to quantify spatial and temporal variability in vertical hyporheic flux," Water Resources Research, vol. 48, WO2527, 2012, pp. 1-16.

Hwang, Dusun et al.; "Novel auto-correction method in a fiber-optic distributed-temperature sensor using reflected anti-Stokes Raman scattering," Optics Express, vol. 18, No. 10, May 10, 2010, pp. 9747-9754.

Suarez, F. et al.; "Assessment of a vertical high-resolution distributed-temperature-sensing system in a shallow thermohaline environment," Hydrol. Earth Syst. Sci., 15, 2011, pp. 1081-1093.

Van De Giesen, Nick et al.; "Double-Ended Calibration of Fiber-Optic Raman Spectra Distributed Temperature Sensing Data," Sensors, 2012, 12, pp. 5471-5485.

PCT International Search Report and Written Opinion; International Application No. PCT/US2014/057261; International Filing Date: Sep. 24, 2014; dated Jan. 7, 2015; pp. 1-16.

PCT International Search Report and Written Opinion; International Application No. PCT/US2014/057262; International Filing Date: Sep. 24, 2014; dated Jan. 9, 2015; pp. 1-17.

PCT International Search Report and Written Opinion; International Application No. PCT/US2014/057263; International Filing Date: Sep. 24, 2014; dated Jan. 9, 2015; pp. 1-18.

Clanton et al., Real-Time Monitoring of Acid Stimulation Using a Fiber-Optic DTS System, SPE 100617, presentation at the 2006 SPE Western Regional/AAPG Pacific Section/GSA Cordilleran Section Joint Meeting, Anchorage, Alaska, May 8-10, 2006, pp. 1-10.

Johnson et al., DTS Transient Analysis: A New Tool to Assess Well-Flow Dynamics, 2006, Society of Petroleum Engineers, 2006 SPE Annual Technical Conference and Exhibition held in San Antonio, Texas, U.S.A., Sep. 24-27, 2006, pp. 1-11.

Tabatabaei et al., Fracture-Stimulation Diagnostics in Horizontal Wells Through Use of Distributed-Temperature-Sensing Technology, Nov. 2012, SPE Production & Operations, pp. 356-362.

Tabatabaei et al., Interpretation of Temperature Data During Acidizing Treatment of Horizontal Wells for Stimulation Optimization, IPTC 15214, presentation at the International Petroleum Technology Conference, Bangkok, Thailand, Feb. 7-9, 2012, pp. 1-16.

Tabatabaei et al., Theoretical Basis for Interpretation of Temperature Data During Acidizing Treatment of Horizontal Wells, SPE 163138, May 2013 SPE Production & Operations, first presented at the IPTC, Bangkok, Thailand, Nov. 15-17, 2011, pp. 1-13.

Tan et al., Field Application of Inversion Method to Determine Acid Placement with Temperature Profiles, Oct. 2012, SPE 159296, SPE Annual Technical Conference and Exhibition, San Antonio, Texas, U.S.A., Oct. 8-10, 2012, pp. 1-19.

Tan et al., Measurement of Acid Placement with Temperature Profiles, SPE 144194, presentation at the SPE European Formation Damage Conference, Noordwijk, The Netherlands, Jun. 7-10, 2011, pp. 1-14.

Xuehao Tan, Dissertation: Diagnosis of Acid Placement From Downhole Temperature Measurements, Aug. 2012, Office of Graduate Studies of Texas A&M University, 123 pages.

* cited by examiner

HIGH RESOLUTION DISTRIBUTED TEMPERATURE SENSING FOR DOWNHOLE MONITORING

CROSS REFERENCE TO RELATED APPLICATIONS

The present application is related to U.S. patent application Ser. No. 14/062561, filed Oct. 24, 2013, now abandoned, the contents of which are hereby incorporated herein by reference in their entirety.

BACKGROUND OF THE DISCLOSURE

1. Field of the Disclosure

The present application relates to methods for increasing a resolution of measurements obtained downhole and, in particular, to methods for increasing resolution of temperature measurements obtained using a distributed temperature sensing system in a wellbore.

2. Description of the Related Art

Temperature measurements obtained in a wellbore can be useful in performing downhole operations such as determining a placement of an injection fluid, determining an injection profile, determining a production profile, determining an oil/liquid interface, etc. One method of obtaining temperature measurements downhole includes the use of a distributed temperature sensing (DTS) system. DTS systems measure temperatures by means of one or more optical fibers functioning as distributed sensor arrays. The one or more optical fibers are generally run along the wellbore. Temperatures are recorded along the optical fiber as a continuous profile. The DTS system generally provides a temperature measurement having a spatial resolution from about 0.5 meters to about 1 meter and a temperature resolution from about 1.5° C. to about 0.5° C. when measured at a scan rate of one to several minutes. At a deep downhole location, the geothermal environment is thermally stable. Microvariations in temperature occurring downhole may be indicative of a geological event, a wellbore operation, a well integrity issue, a flow assurance problem, or a change in the status of downhole control devices, etc. The microvariations associated with these events, issues and/or operations are generally below the level of resolution directly provided by current DTS systems.

SUMMARY OF THE DISCLOSURE

In one aspect, the present disclosure provides a method of obtaining a temperature profile of a wellbore, the method including: obtaining raw temperature data from the wellbore using a distributed temperature sensor system, the raw temperature data including noise; performing a numerical decomposition of the raw temperature data within a dynamic window in measurement space of the raw temperature data to obtain decomposition terms of first order and higher; applying an adaptive filter to the dynamic window to reduce noise from the decomposition terms of first order and higher; and using the filtered decomposition terms of first order and higher to obtain a temperature profile of the wellbore.

In another aspect, the present disclosure provides a system for obtaining a temperature profile at a downhole location, the system including: a distributed temperature system configured to obtain raw temperature data from the downhole location, wherein the raw temperature data includes noise; and a processor configured to: perform a numerical decomposition of the raw temperature data within a dynamic window in measurement space of the raw temperature data to obtain decomposition terms of first order and higher; apply an adaptive filter to the dynamic window to reduce noise from the decomposition terms of first order and higher; and use the filtered decomposition terms of first order and higher to obtain a temperature profile of the wellbore.

In yet another aspect, the present disclosure provides a computer-readable medium having instructions stored thereon that are accessible to a processor and enable the processor to perform a method for obtaining a temperature profile at a downhole location, the method including: obtaining raw temperature data from the downhole location from a distributed temperature sensor system; performing a numerical decomposition of the raw temperature data within a dynamic window in measurement space of the raw temperature data to obtain decomposition terms of first order and higher; applying an adaptive filter to the dynamic window to reduce noise from the decomposition terms of first order and higher; and using the filtered decomposition terms of first order and higher to obtain a temperature profile of the wellbore.

summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

The present disclosure is best understood with reference to the accompanying figures in which like numerals refer to like elements and in which.

DETAILED DESCRIPTION OF THE DISCLOSURE

Figure 1:
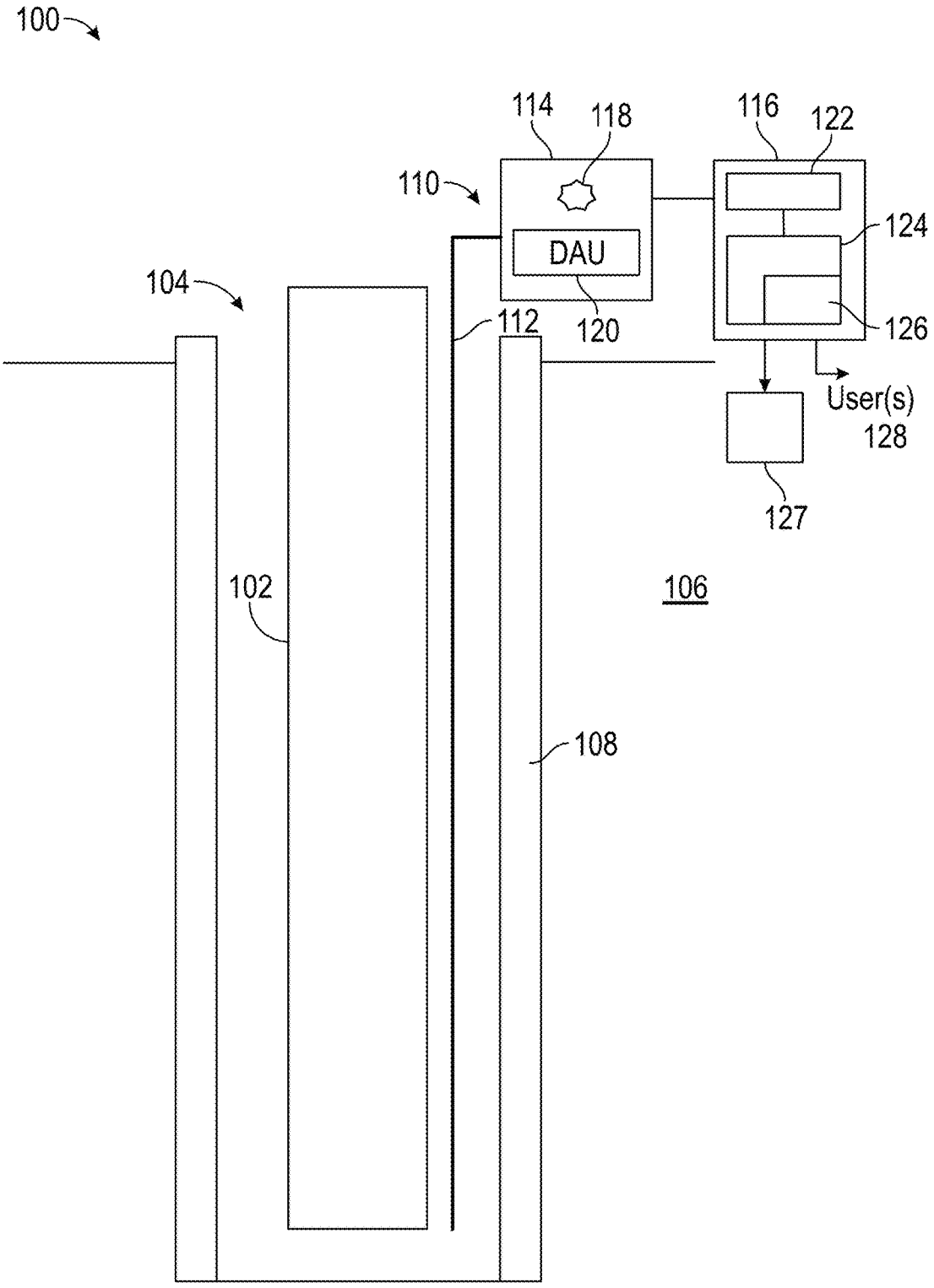
FIG. 1 shows a wellbore system having a distributed temperature system for determining a temperature at a downhole location in an exemplary embodiment of the present disclosure.

FIG. 1 shows a wellbore system 100 having a distributed temperature sensing system 110 for determining a temperature at a downhole location in an exemplary embodiment of the present disclosure. The exemplary wellbore system 100 includes a tubular member 102 disposed in a wellbore 104 formed in a formation 106. The wellbore 104 may be lined with a casing string 108 and the member 102 may be a casing string or disposed inside the casing string 108. In the latter case, the member 102 may be a production tubing, a coiled tubing, or a downhole tool in various embodiments.

The wellbore system 100 further includes a distributed temperature sensing (DTS) system 110 that is used to obtain a temperature profile along the wellbore 104 over a selected time interval. The DTS system 110 includes fiber optic cable 112 that extends downhole, generally from a surface location. In the embodiment of FIG. 1, fiber optic cable 112 is disposed alongside member 102. In other embodiments, the fiber optic cable 110 may be disposed along the casing string 108 or between the casing string 108 and the formation 106. Thus, the fiber optic cable may be either permanently deployed or may be removable from the wellbore along with the removable member to which it is attached.

The DTS system 110 includes an optical interrogator 114 which is used to obtain raw temperature measurements from the fiber optic cable 112. The optical interrogator 114 includes a laser light source 118 that generates a short laser pulse that is injected into the fiber optic cable 112 and a digital acquisition unit (DAU) 120 for obtaining optical signals from the fiber optic cable 112 in response to the laser pulse injected therein. The obtained optical signals are indicative of temperature. In one embodiment, Raman scattering in the fiber optic cable 112 occurs while the laser pulse travels along the fiber, resulting in a pair of Stokes and anti-Stokes peaks. The anti-Stokes peak is highly responsive to a change in temperature while the Stokes peak is not. A relative intensity of the two peaks therefore provides a measurement indicative of temperature change. The back-reflected Raman scattering (i.e., the Stokes and anti-Stokes peaks) may thus transmit the temperature information of a virtual sensor while the laser pulse is travelling through the fiber optic cable 112. The location of the virtual sensor is determined by the travel time of the returning optical pulse from the interrogator 114 to the signal detector 120.

The DAU 120 obtains raw temperature measurement data (raw data) and sends the raw data to a data processing unit (DPU) 116. The DPU 116 performs the various methods disclosed herein for increasing a resolution of temperature measurements, among other things. The DPU 116 may include a processor 122 for performing the various calculations of the methods disclosed herein. The DPU 116 may further comprise a memory device 124 for storing various data such as the raw data from the DAU 120 and various calculated results obtained via the methods disclosed herein. The memory device 124 may further include programs 126 containing a set of instructions that when accessed by the processor 122, cause the processor 122 to perform the methods disclosed herein. The DPU 116 may provide results of the calculations to the memory device 124, display 127 or to one or more users 128. In various embodiments, the DPU 116 may wrap the resulting high-resolution DTS data into a managed data format that may be delivered to the users 128. The DPU 116 may be in proximity to the DAU 120 to reduce data communication times between the DPU 116 and DAU 120. Alternatively, the DPU 116 may be remotely connected to the DAU 120 through a high-speed network.

The raw data obtained at the DAU 120 may include noises at levels that are in a range from one to several degrees Celsius. Such noises may originate due to attenuation loss, noise in the data acquisition system, environmental temperature variations of the fiber optic cable, etc. In one embodiment, the present disclosure provides an adaptive filter to reduce those noises to thereby increase a resolution of the temperature measurements. In one embodiment, the temperature resolution of the data after the filtering methods described herein may be greater than the resolution of the raw temperature measurement data. In an exemplary embodiment, a resolution of raw temperature measurement data that is from about 0.5° C. to about 1.5° C. may be processed using the methods disclosed herein to obtain a post-filtered resolution of about ten millidegrees Celsius. In general, an increase in temperature resolution may be about two orders of magnitude.

Figure 2:
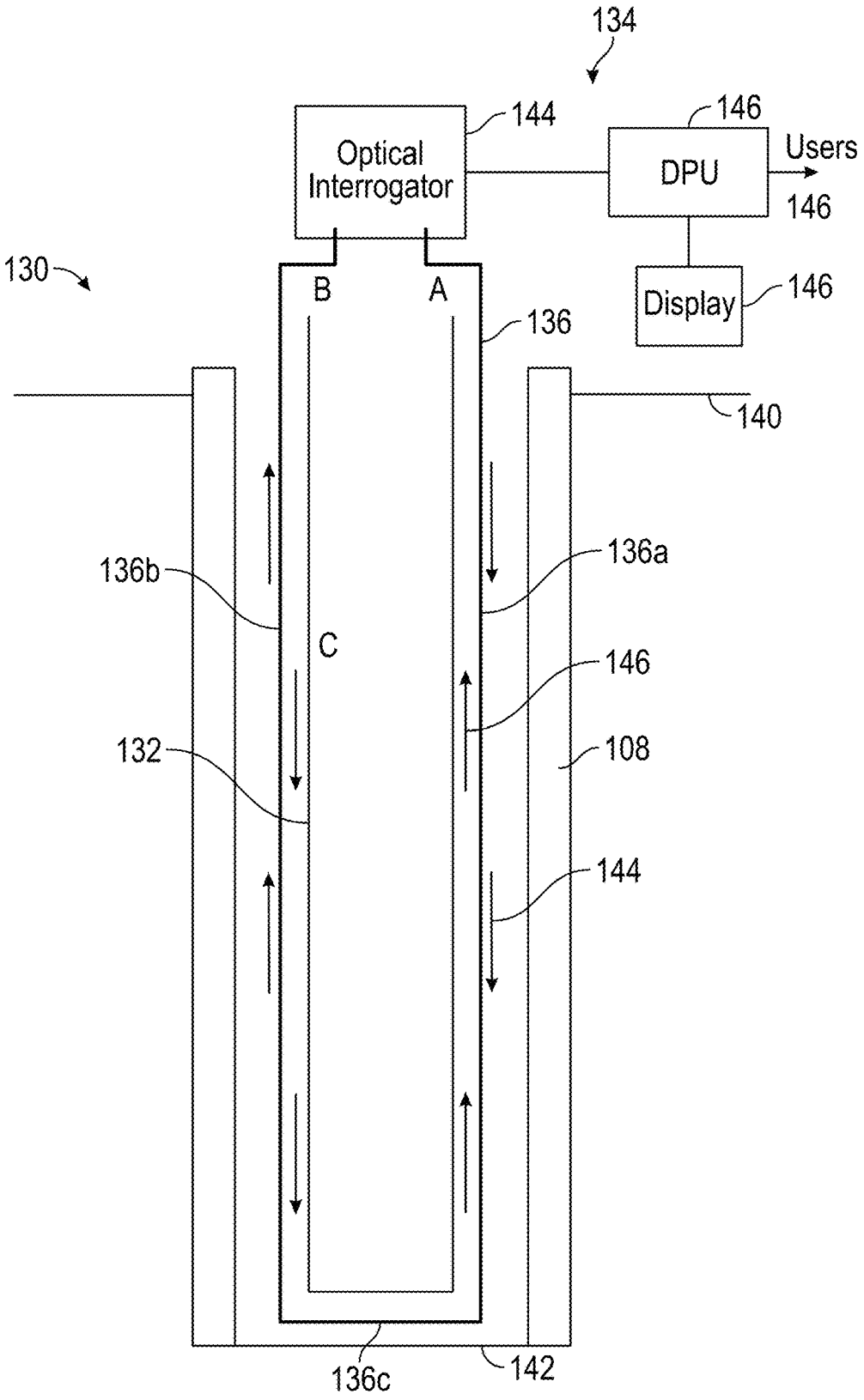
FIG. 2 shows an alternate embodiment of a wellbore system suitable for temperature measurements according to the present disclosure.

FIG. 2 shows an alternate embodiment of a wellbore system 120 suitable for temperature measurements according to the present disclosure. The alternate wellbore system 120 includes a member 132 having a DTS system 134 attached thereto in which a fiber optic cable 136 of the DTS system 134 is a dual-ended cable. The fiber optic cable 136 has a first leg **136*a* that extends from a surface location 140 to a bottom location 142 along one side of the member 132 and a second leg 136*b* that may extend from the bottom location 142 back to the surface location 140 along a same side of the member 132. A third segment 136*c* of the fiber optic cable 136 may wrap around the bottom of the member 132. Both ends of the fiber optic cable 136 are coupled to the interrogator unit 144. Thus, source laser light generated at the interrogator unit 134 may enter the fiber optic cable at point A and propagate in one direction, referred to herein as a forward direction and indicated by arrows 144, to return to the interrogator unit 134 at point B. Temperature measurements may thus be obtained for the laser light propagating in the forward direction. Alternatively, source laser light may enter the fiber optic cable at point B and propagate in an opposite direction, referred to herein as a backward direction and indicated by arrows 146, to return to the interrogator 134** at point A. Temperature measurements may be obtained for the laser light propagating in the backward direction.

The raw temperature measurements obtained from the DTS systems of FIGS. 1 and 2 exist in a locally-compact measurement space that is correlative and expandable. A two-dimensional measurement space in time and depth for the temperature measurements may be written as:

$$R(t,z|0<t<\infty,-\infty<z<\infty) \quad \text{Eq. (1)}$$

for which there exists a subspace $$R_{i,j}(t,z|t_{i-n_t}<t<t_{i+n_t}z_{j-n_z}<z<z_{j+n_z}) \quad \text{Eq. (2)}$$

(also referred to herein as $R_{ij}$) where $2n_t$ and $2n_z$ are respectively the dimensions for a window defining this subspace within the two-dimensional measurement space.

Figure 3:
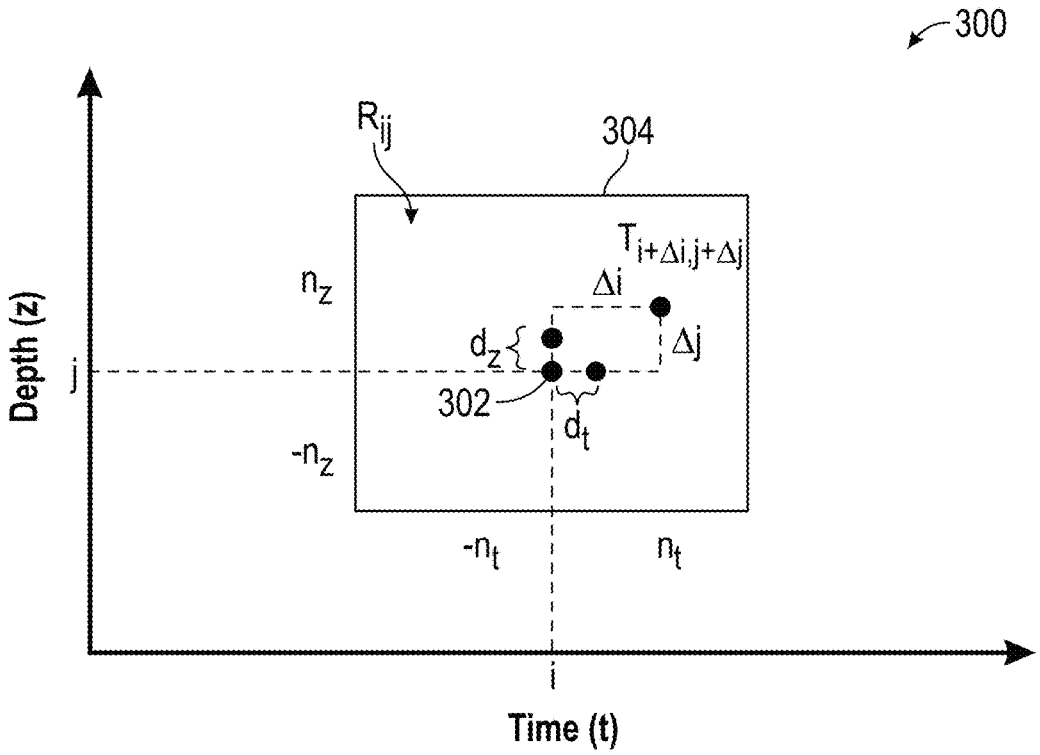
FIG. 3 shows an exemplary data boundary of a localized two-dimensional subspace of the measurement space.

FIG. 3 shows an exemplary data boundary of a localized two-dimensional subspace $R_{ij}$ of the measurement space. The data boundary may be related to raw temperature measurement data and may be used in the exemplary filtration method described herein to filter the temperature measurements input into the filter. Signal point 302 is plotted as a function of the variables time (t) and depth (z), with the time plotted along the x-axis and the depth plotted along the y-axis. As shown in FIG. 3, exemplary signal point 302 is located at (i,j). In one aspect, window 304 is drawn around and centered at the exemplary signal point 302 to the selected subspace $R_{ij}$. The dimension of the window 304 may define parameters of the applied filter. The window 304 has dimensions of $2n_t+1$ along the time axis and $2n_z+1$ along the depth axis and extends from $i-n_t$ to $i+n_t$ along the time axis and from $j-n_z$ to $j+n_z$ along the depth axis. The dimensions of the window 304 may affect a finite impulse response of a filter defined over the measurement subspace.

If $n_t$ and $n_z$ are of a selected size, for a raw temperature measurement $T_{i\Delta i,j+}$ which falls into the subspace $R_{ij}$, a Taylor series expansion may be used to correlate measurements for the current window with that of the center point $T_{i,j}$ of the subspace using the following expression:

$$T_{i+\Delta i,j+\Delta j} = T_{i,j} + \left(\frac{\partial T}{\partial t}\right)_{i,j} \Delta i d_t + \left(\frac{\partial T}{\partial z}\right)_{i,j} \Delta j d_z + \left(\frac{\partial^2 T}{\partial t^2}\right)_{i,j} \frac{(\Delta i d_t)^2}{2} + \left(\frac{\partial^2 T}{\partial z^2}\right)_{i,j} \frac{(\Delta j d_z)^2}{2} + \left(\frac{\partial^2 T}{\partial t \partial z}\right)_{i,j} \frac{(\Delta i \Delta j d_t d_z)^2}{2} + \ldots \quad \text{Eq. (3)}$$

where $d_t$ and $d_z$ are respectively the distances along the temporal axis and the spatial axis between two neighboring sensing points within the measurement space, as shown in FIG. 3. Eq. (3) defines a multiple term decomposition of the DTS data, wherein the decomposition includes a Taylor series decomposition having terms of selected orders, e.g. first order terms, second order terms, etc. Each term of the Taylor series decomposition generally has an associated physical meaning and provides a different level of resolution to the raw temperature measurement data. The present disclosure employs a non-orthogonal transform of the Taylor series decomposition of Eq. (3) limited to a selected number of these representations. In one embodiment, terms of the Taylor series composition up to the second order are used and terms that are of orders higher than two are not considered. Equation (3) may thus be rewritten as:

$$T_{i+\Delta i,j+\Delta j} = \vec{\boldsymbol{H}}_{i+\Delta i,j+\Delta j} \cdot \vec{\boldsymbol{T}}_{i,j} = \Sigma_{k=0}^{5} h_{\Delta i,\Delta j}^{k} \mathcal{J}_{i,j}^{k} \quad \text{Eq. (4)}$$

where $\vec{\boldsymbol{H}}_{i,j}$ denotes a non-orthogonal transformation vector, and $\vec{\boldsymbol{H}}_{i,j}$ denotes a vector containing the terms that are to be determined for the giving point (i,j). A linear reconstruction of the measurement $T_{i,j}$ in the subspace $R_{i,j}$ may be obtained by maximizing the energy compaction for the given transformation vector or, equivalently, by minimizing an expectation value of a linear estimator function:

$$\Sigma_{k=0}^{5} E[\|\Gamma_{i,j}^{k} - \hat{\Gamma}_{i,j}^{k}\|^2] \quad \text{Eq. (5)}$$

where, $\hat{\Gamma}_{i,j}^{k}$ is the mean value of $\Gamma_{i,j}^{k}$ is a collection of the $k^{th}$ term of the decomposition of the temperature measurements in subspace $R_{ij}$. In particular, $\Gamma_{i,j}^{k}$ are the elements of vector $\mathcal{J}_{i,j}^{k}$ as illustrated with respect to Eq. (8) below. Referring back to Eq. (5), $$\Gamma_{i,j}^{k} = \Gamma_{i,j}^{k-1} \hat{\Gamma}_{i,j}^{k-1} \quad \text{Eq. (6)}$$

where $\Gamma_{i,j}^{0} = \hat{\Gamma}_{i,j}$ is the actual raw temperature measurement ($T_{i,j}$, in the measurement subspace and which may be a function of time and depth. Eq. (6) defines a generally time-consuming approach to the non-orthogonal transform problem, in which a $k^{th}$ representation is progressively obtained using the $(k-1)^{th}$ representation. However, the present disclosure speeds this process by using a single step approach in which the expectation of the linear estimator function (Eq. (5)) is rewritten as:

$$\Sigma_{\Delta i=-n_t}^{n_t} \Sigma_{\Delta j=-n_z}^{n_z} (T_{i+\Delta i,j+\Delta j} - \Sigma_{k=0}^{5} h_{\Delta i \Delta j}^{k} \mathcal{J}_{i,j}^{k})^2 \quad \text{Eq. (7)}$$

where $\mathcal{J}_{i,j}$ is a vector containing the following physical quantities:

$$\vec{\mathcal{T}}_{i,j} = \left(T_{i,j}, \left(\frac{\partial T}{\partial t}\right)_{i,j}, \left(\frac{\partial T}{\partial z}\right)_{i,j}, \left(\frac{\partial^2 T}{\partial t^2}\right)_{i,j}, \left(\frac{\partial^2 T}{\partial z^2}\right)_{i,j}, \left(\frac{\partial^2 T}{\partial t \partial z}\right)_{i,j}\right)^T \quad \text{Eq. (8)}$$

By defining a linear transfer function:

$$\mathcal{H} = H(H^T H^T H)^{-1} H^T \quad \text{Eq.(9)}$$

with $$H = \begin{pmatrix} h_{-n_t,-n_z}^{0} & \cdots & h_{-n_t,-n_z}^{5} \\ \vdots & \ddots & \vdots \\ h_{n_t,n_z}^{0} & \cdots & h_{n_t,n_z}^{5} \end{pmatrix}, \quad \text{Eq. (10)}$$

we can obtain the following solution:

$$\mathcal{J}_{i,j} = \mathcal{H} \Gamma_{i,j} \quad \text{Eq.(11)}$$

This solution to the Taylor series decomposition may also be viewed as a 2-dimensional filter for digitally filtering the raw temperature measurement data. Since the higher-order terms (i.e., terms of order greater than 2)in the Taylor series decomposition are not considered, $\mathcal{H}$ in Eq. (9)is only an approximate transfer function in which the approximation error depends on the size of subspace $R_{ij}$. Therefore, a window size suitable for obtaining selected filtration results may be selected. An iterative self-adaptive algorithm, as shown in FIG. 4 achieves this filtration result to a selected approximation error.

Figure 4:
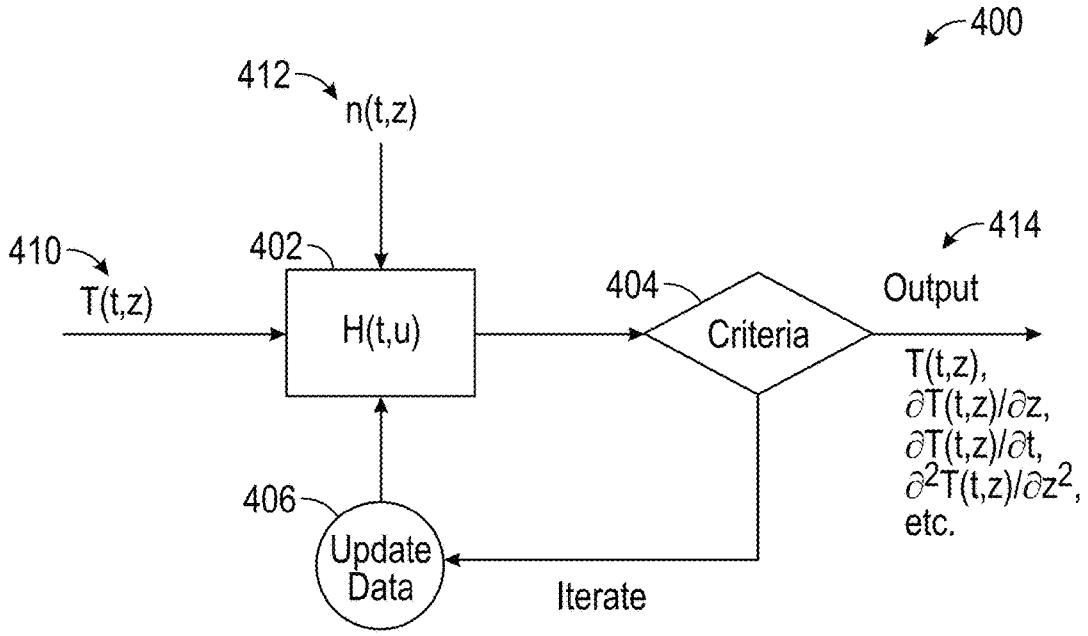
FIG. 4 shows a schematic diagram of an iterative self-adaptive algorithm of the present disclosure.

FIG. 4 shows a schematic diagram 400 of an iterative self-adaptive filtering process of the present disclosure. The iterative filtering process may be used to provide an accuracy or resolution of temperature measurements to within a selected approximation error. The filtering process preserves transition information for the set of continuous temperature measurement data.

Temperature signal T(t,z) 410 represents a raw DTS temperature measurement obtained from a DTS system which is an input signal to the filter system 400. Noise signal n(t,z) 412 indicates an unknown noise signal accompanying the temperature measurements 410 and which is also input to the filter system 400. In general, the temperature signal 410 and the noise signal 412 are indistinguishable in DTS systems and thus are input to filter 402 as a single measurement. In addition, noise signal n(t,z) 412 is often not constant but changes with changes in environment. Therefore, both temperature signal T(t,z) 410 and noise signal n(t,z) 412 are dependent on time and depth of the measurement location in the DTS system. Output signal 414 is a filtered output signal and may include multiple terms of the decomposition of Eq. (3), such as for $$T_{i,j}, \left(\frac{\partial T}{\partial t}\right)_{i,j}, \left(\frac{\partial T}{\partial z}\right)_{i,j},$$

etc.

In one embodiment, the exemplary filter 402 is a self-adaptive filter using a dynamic window (such as data window 304 in FIG. 3) that may be adjusted to reduce noise in the temperature measurements. The temperature signal 410 and noise signal 412 are fed to filter 402 which provides an approximation to the temperature measurements using the methods disclosed above with respect to Equations (1)-(12). In various embodiments, the approximation may provide values for one or more of terms $$T_{i,j}, \left(\frac{\partial T}{\partial t}\right)_{i,j}, \left(\frac{\partial T}{\partial z}\right)_{i,j}.$$

A criterion 404 may then be applied to the terms output from the filter 402 to determine an effectiveness of the filter 420. In one embodiment, the selected criterion may be a selected resolution of the temperature measurements or a selected resolution for a selected term of the decomposition. If the filtered terms are found to be within the selected resolution, the filtered terms may be accepted as output signals 414. Otherwise, the filter 402 may be updated at updating stage 406. Updating may include, for example, changing the dimensions of the measurements subspace $R_{ij}$. In various embodiments, this decomposition process represents DTS measurement data as a Taylor series decomposition that includes terms having various levels of temperature resolution. The first order terms have a resolution that is greater than zero-order terms, the second order terms have a resolution greater than the first order terms, etc. The first order terms, which are thermal derivatives in depth or time and the second order derivatives (i.e., variance with respect to depth, variance with respect to time and variance with respect to depth and time) may reach temperature resolutions up to several hundredths of a degree.

Although the methods are discussed with respect to temperature measurements, the present disclosure may also be applied to any suitable signal that is a continuous function measured in a two-dimensional measurement space. While the method is described with respect to a Taylor series decomposition (Eq. (3)), other numerical decompositions may be also used in various alternate embodiments.

The methods disclosed herein may be applied to both single and double ended DTS measurements. For the latter application, a correction of the asymmetry of temperature measurements may be performed. As shown in FIG. 2, the raw temperature data are obtained for both forward and backward propagation directions of the laser light transmitting along the double-ended DTS cable 136. In general, the data from the two legs (136*a* and 136*b*, FIG. 2) are not symmetric predominantly due to attenuation loss of the laser light which makes the amplitude of light propagating, at a selected fiber position (e.g. point C), in the forward direction not the same as the amplitude of the light propagating in the backward direction. Correcting for this asymmetrical attenuation using the methods disclosed herein may increase resolution, especially for the first order terms and higher.

Figure 5:
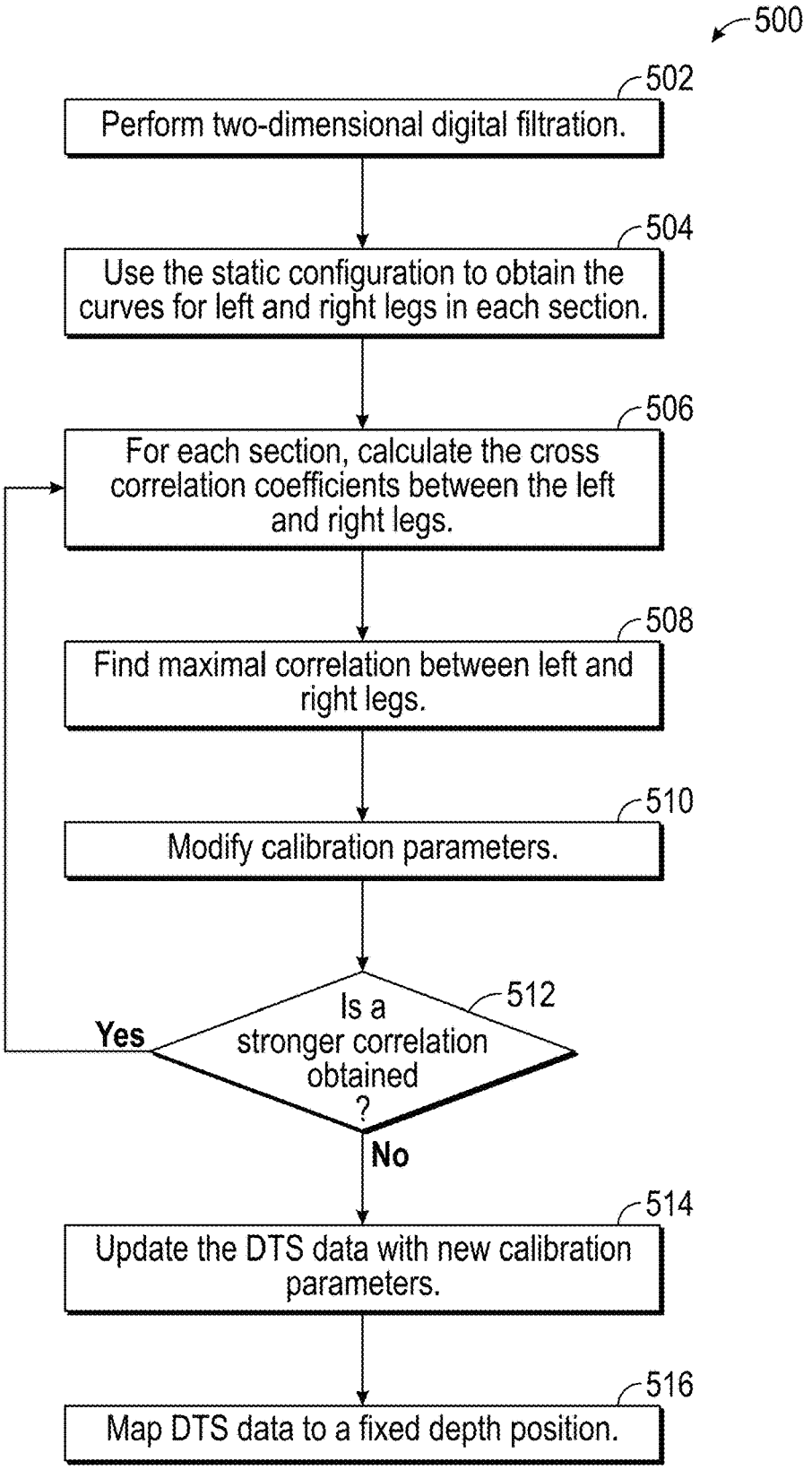
FIG. 5 shows a flowchart illustrating an exemplary method of correcting bi-directional DTS temperature measurements for asymmetric signal loss.

FIG. 5 shows a flowchart 500 illustrating an exemplary method of correcting bi-directional DTS temperature measurements for asymmetric data. In block 502, a two-dimensional digital filtration process, such as discussed with respect to FIG. 4, is performed. In block 504, temperature curves for left and right legs are obtained for one or more sections of the member. In block 506, for a selected section, cross-correlation coefficients are calculated for temperature measurements in the left and right legs. In block 508, a maximal correlation is found using the cross-correlation coefficients obtained in block 506. In block 510, calibration parameters are modified. In one aspect, some of the calibration parameters may be used to correct a depth misalignment between the two legs (136*a* and 136*b*, FIG. 2). In another aspect, at least one of the calibration parameters may be used to offset the systematic temperature differences in the forward and backward propagating data measurements. In block 512, a determination is made on whether the modified calibration parameters provide a stronger correlation. If a stronger correlation is not obtained with the modified calibration parameters, then the method returns to block 506 to calculate cross-correlation coefficients. If a stronger correlation is obtained, the method proceeds to block 514 in which DTS data is updated using the calibration parameters that provide the stronger correlation. After block 514, in block 516 the updated DTS data is mapped to a fixed depth position of the member.

Figure 6:
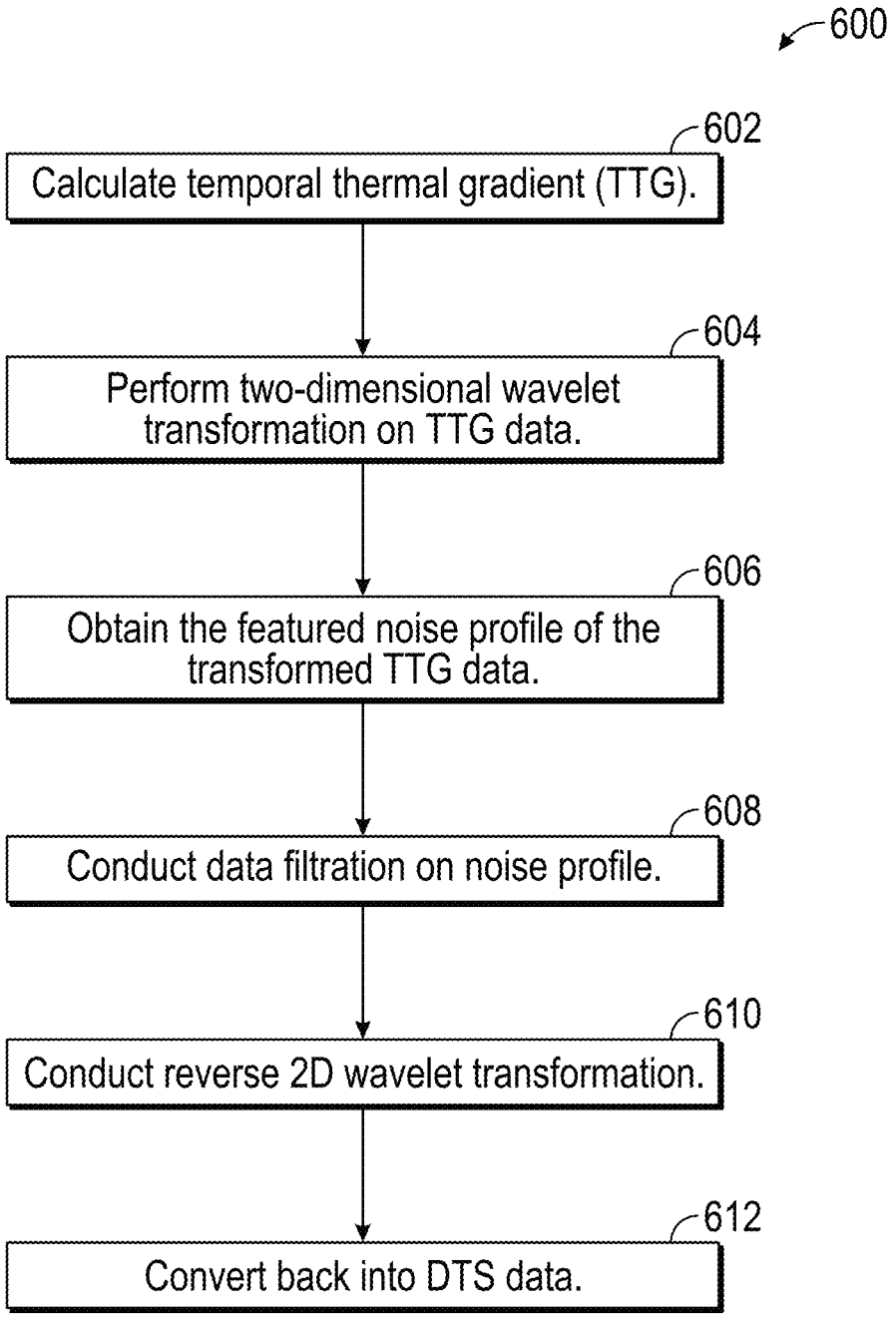
FIG. 6 show a flowchart illustrating an exemplary method of reducing system level noises in the DTS data.

FIG. 6 shows a flowchart 600 illustrating an exemplary method of reducing system level noises in the DTS data. The system level noise may include a systemic fluctuation of DTS data from one scan to another, or an oscillation of the temperature thermal gradient (TTG). In block 602, temporal thermal gradient (TTG) data is calculated. The TTG data may be a representation output from the filtering process shown in FIG. 4, and specifically the partial derivative with respect to time, $\partial T(t,z)/\partial t$. In block 604, a two-dimensional wavelet transformation is performed on the TTG data. In block 606, a featured noise profile is obtained. In block 608, data filtration is conducted in the transformed space. In block 610, a reverse two-dimensional wavelet transformation is performed to obtain filtered TTG data. In block 612, the filtered TTG data may be used to obtain DTS temperature data with reduced noise.

Figure 7:
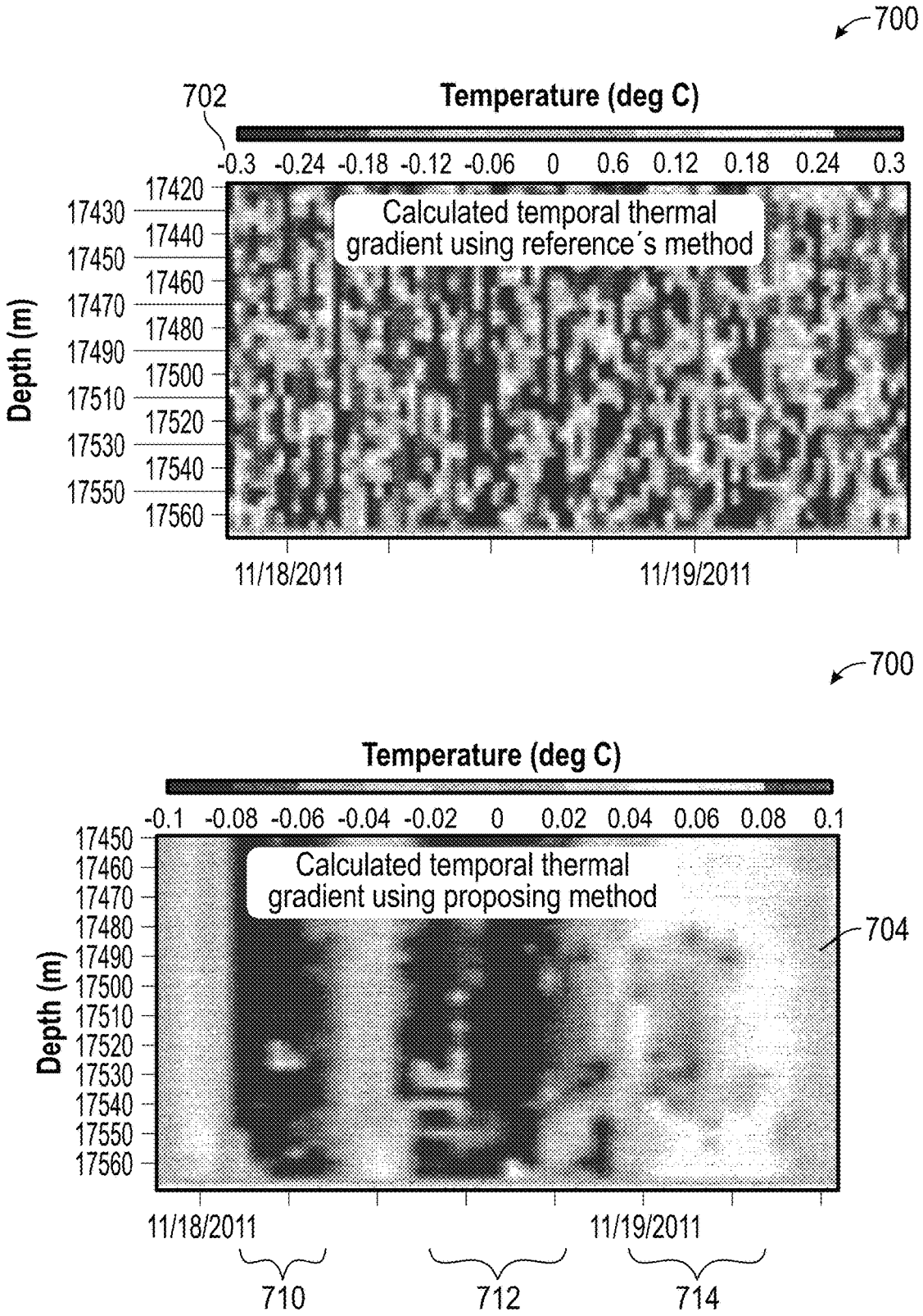
FIG. 7 shows various thermal gradient data sets obtained using a distributed temperature system measurements.
Figure 7:
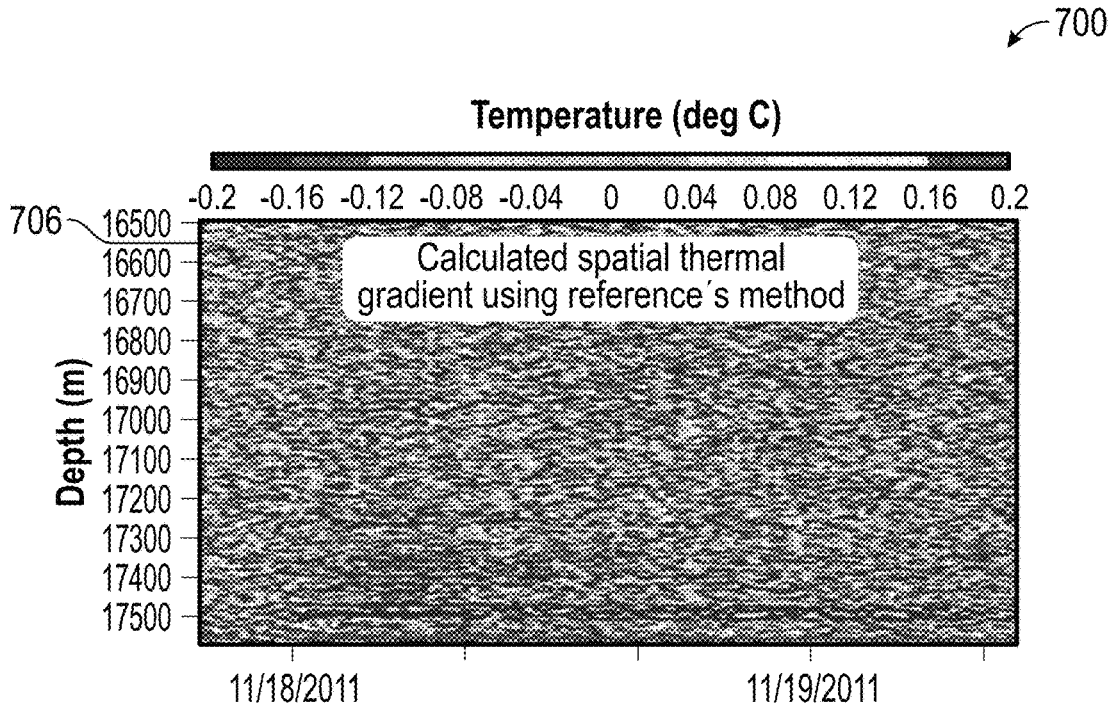
Figure 7:
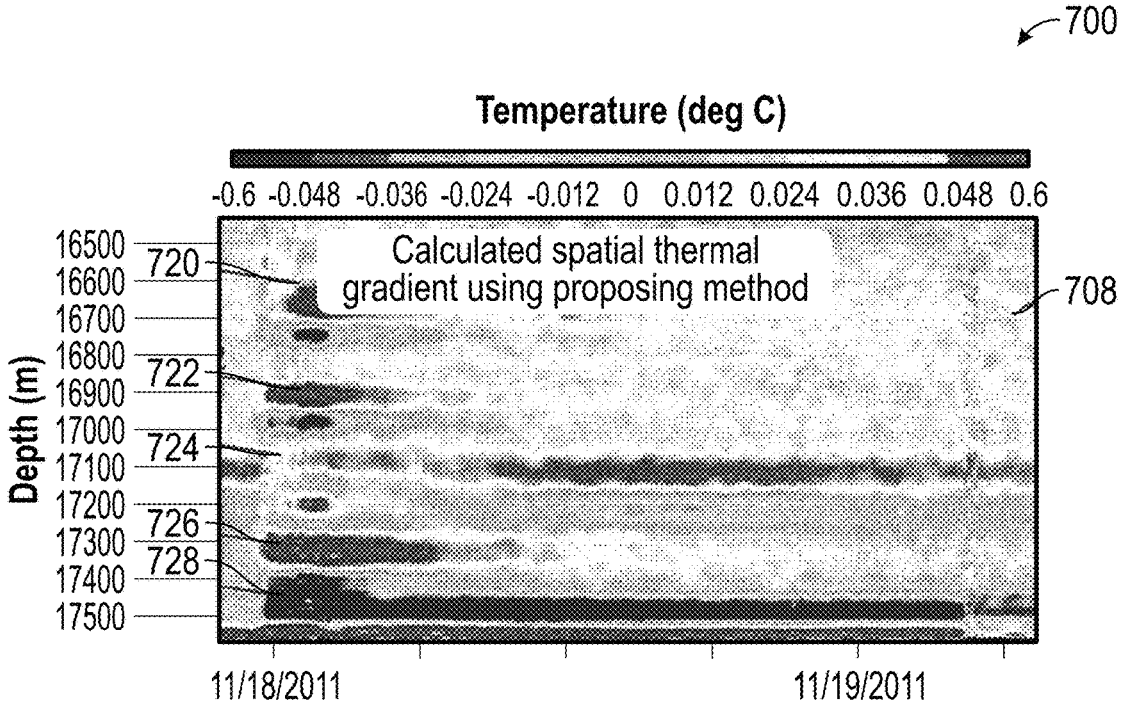

FIG. 7 shows various thermal gradient data sets obtained using a DTS measurement. The data set 702 shows temporal thermal gradient data obtained from raw temperature data over a selected depth interval (along the y-axis) and over a selected time interval (along the x-axis). In one embodiment, the data set 702 may be obtained using a three-point central difference formula after taking five-point moving average of raw temperature data. The data set 702 may be color coded to indicate a cooling or a heating of the wellbore or formation. For example, a red color at a selected time and depth indicates that temperature is increasing at the selected time and depth. A blue color at a selected time and depth indicates that temperature is decreasing at the selected time and depth. A green color indicates that temperature is constant. The data set 704 is a temporal thermal gradient profile obtained using the same DTS data as in temperature data set 702 and the methods disclosed herein. While data set 702 shows a strong noise background that covers the actual temperature signal, data set 704 displays a strong temperature signal. In data set 704, the temperature at substantially all depths is decreasing (cooling) during time intervals 710 and 712, and is increasing (heating) during time interval 714. Between these time intervals 710, 712 and 714, the temperature remains constant, as indicted by the green color. The decrease in temperature in time intervals 710 and 712 may be related to the occurrence of two consecutive liquid injections, in one embodiment.

Temperature data set 706 shows a color map of a spatial thermal gradient (STG) obtained over a depth interval for a selected time period or time interval. The data set 706 is obtained using the same three-point central difference formula used with respect to data set 702. Temperature data set 708 is the STG color map obtained using the same data set 706 and the methods disclosed herein. Data sets 704 and 708 provide evidences that the disclosed method is capable of retrieving clear signals on temperature gradient with respect to depth from a generally noisy raw DTS data set. While very little in the way of a distinguishable temperature signal may be found in data set 706, distinctive signals at depths 720, 722, 724, 726 and 728 (in data set 708) are displayed. Any of the signals at depths 720, 722, 724, 726 and 728 may be related, in various embodiments, to a change in a size of a tubular used for water injection, in a change in fluid flow direction such as a crossover, a liquid entrance to the formation, an acid reaction with carbonate formation, etc.

Therefore in one aspect, the present disclosure provides a method of obtaining a temperature profile of a wellbore, the method including: obtaining raw temperature data from the wellbore using a distributed temperature sensor system, the raw temperature data including noise; performing a numerical decomposition of the raw temperature data within a dynamic window in measurement space of the raw temperature data to obtain decomposition terms of first order and higher; applying an adaptive filter to the decomposition terms of first order and higher within the dynamic window to reduce noise from the decomposition terms of first order and higher; and using the filtered decomposition terms of first order and higher to obtain a temperature profile of the wellbore. In one embodiment, the method further includes calibrating a measurement depth using a heat source at a known depth.

In another aspect, the present disclosure provides a system for obtaining a temperature profile at a downhole location, the system including: a distributed temperature system configured to obtain raw temperature data from the downhole location, wherein the raw temperature data includes noise; and a processor configured to: perform a numerical decomposition of the raw temperature data within a dynamic window in measurement space of the raw temperature data to obtain decomposition terms of first order and higher; apply an adaptive filter to the decomposition terms of first order and higher within the dynamic window to reduce noise from the decomposition terms of first order and higher; and use the filtered decomposition terms of first order and higher to obtain a temperature profile of the wellbore.

In yet another aspect, the present disclosure provides a computer-readable medium having instructions stored thereon that are accessible to a processor and enable the process to perform a method for obtaining a temperature profile at a downhole location, the method including: obtaining raw temperature data from the downhole location from a distributed temperature sensor system; performing a numerical decomposition of the raw temperature data within a dynamic window in measurement space of the raw temperature data to obtain decomposition terms of first order and higher; applying an adaptive filter within the dynamic window to reduce noise on the decomposition terms of first order and higher; and using the filtered decomposition terms of first order and higher to obtain a temperature profile of the wellbore.

While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method of identifying a reaction of a fluid in a wellbore, comprising:

introducing the fluid into a formation;

propagating light through a dual ended cable of a distributed temperature sensor system extending along a member in the wellbore in a forward direction to obtain a first raw temperature data from the wellbore;

propagating light through the dual ended cable in a backward direction to obtain a second raw temperature data from the wellbore, the first and second raw temperature data being indicative of the reaction of the fluid with the formation and including noise;

performing a first numerical decomposition of the first raw temperature data within a first dynamic window in measurement space of the first raw temperature data to obtain first decomposition terms of first order and higher;

applying a first adaptive filter to the first dynamic window to reduce noise from the first decomposition terms of first order and higher from the first raw temperature data to obtain first filtered decomposition terms of first order and higher;

performing a second numerical decomposition of the second raw temperature data within a second dynamic window in measurement space of the second raw temperature data to obtain second decomposition terms of first order and higher;

applying a second adaptive filter to the second dynamic window to reduce noise from the second decomposition terms of first order and higher from the second raw temperature data to obtain second filtered decomposition terms of first order and higher;

correcting a depth misalignment between the first raw temperature data and the second raw temperature data using a cross-correlation of the first raw temperature data and the second raw temperature data;

using at least one of the first filtered decomposition terms of first order and higher and the second filtered decomposition terms of first order and higher to display a profile of temporal thermal gradient values on a graph of wellbore depth vs. time; and identifying the reaction of the fluid with the formation from the profile of temporal thermal gradient.

2. The method of claim 1, further comprising using the profile of temporal thermal gradient to determine at least one of: (i) a wellbore operation; (ii) a geologic event; (iii) a well integrity issue; (iv) a flow assurance problem; and (v) a status of downhole flow control devices.

3. The method of claim 1, wherein the first raw temperature data and the second raw temperature data further comprises spatio-temporal temperature measurements obtained over a selected depth interval of the wellbore.

4. The method of claim 1, wherein the first decomposition terms of first order and higher and the second decomposition terms of first order and higher represent at least one of: a gradient of temperature versus depth; a gradient of temperature versus time; a variance of temperature with respect to depth; a variance of temperature with respect to time; and a variance of temperature with respect to both depth and time.

5. The method of claim 1, further comprising increasing a resolution of the first and second raw temperature measurements by two orders of magnitude.

6. A system for identifying a reaction of a fluid in a formation at a downhole location, comprising:

a tubing for introduction of the fluid into the formation;

a distributed temperature system comprising a dual ended cable and an optical interrogator, and configured to propagate light in the dual ended cable in a forward direction and a backward direction, the distributed temperature system configured to obtain first raw temperature data from the downhole location from the propagation of the light in the forward direction and a second raw temperature data from the downhole location from the propagation of the light in the backward direction, wherein the first and second raw temperature data is indicative of the reaction of the fluid with the formation and includes noise; and a processor configured to:

perform a first numerical decomposition of the first raw temperature data within a first dynamic window in measurement space of the first raw temperature data to obtain first decomposition terms of first order and higher;

apply a first adaptive filter to the first dynamic window to reduce noise from the first decomposition terms of first order and higher from the first raw temperature data to obtain first filtered decomposition terms of first order and higher; and perform a second numerical decomposition of the second raw temperature data within a second dynamic window in measurement space of the second raw temperature data to obtain second decomposition terms of first order and higher;

apply a second adaptive filter to the second dynamic window to reduce noise from the second decomposition terms of first order and higher from the second raw temperature data to obtain second filtered decomposition terms of first order and higher;

correct a depth misalignment between the first raw temperature data and the second raw temperature data using a cross-correlation of the first raw temperature data and the second raw temperature data; and use at least one of the first filtered decomposition terms of first order and higher and the second filtered decomposition terms of first order and higher to display a profile of temporal thermal gradient values on a graph of wellbore depth vs. time; and identify the reaction of the fluid with the formation from the profile of temporal thermal gradient.

7. The system of claim 6, wherein the processor is further configured to use the profile of temporal thermal gradient to determine at least one of: (i) a wellbore operation; (ii) a geologic event; (iii) a well integrity issue; (iv) a flow assurance problem; and (v) a status of downhole flow control devices.

8. The system of claim 6, wherein the first and second raw temperature data further comprises spatio-temporal temperature measurements obtained over a selected depth interval of the wellbore.

9. The system of claim 6, wherein the first decomposition terms of first order and higher and the second decomposition terms of first order and higher represent at least one of: a gradient of temperature versus depth; a gradient of temperature versus time; a variance of temperature with respect to depth; a variance of temperature with respect to time; and a variance of temperature with respect to both depth and time.

10. The system of claim 6, further comprising increasing a resolution of the first and second raw temperature measurements by two orders of magnitude.

11. A non-transitory computer-readable medium having instructions stored thereon that are accessible to a processor and enable the processor to perform a method for identifying a reaction of a fluid at a downhole location, the method comprising:

propagating light through a dual ended cable of a distributed temperature sensor system extending along a member in a wellbore in a forward direction to obtain a first raw temperature data from the wellbore;

propagating light through the dual ended cable in a backward direction to obtain a second raw temperature data from the wellbore, the first raw temperature data and the second raw temperature data being indicative of the reaction of the fluid with a formation and including noise;

performing a first numerical decomposition of the first raw temperature data within a first dynamic window in measurement space of the first raw temperature data to obtain first decomposition terms of first order and higher;

applying a first adaptive filter to the first dynamic window to reduce noise from the first decomposition terms of first order and higher for the first raw temperature data to obtain first filtered decomposition terms of first order and higher;

performing a second numerical decomposition of the second raw temperature data within a second dynamic window in measurement space of the second raw temperature data to obtain second decomposition terms of first order and higher;

applying a second adaptive filter to the second dynamic window to reduce noise from the second decomposition terms of first order and higher from the second raw temperature data to obtain second filtered decomposition terms of first order and higher;

correcting a depth misalignment between the first raw temperature data and the second raw temperature data using a cross-correlation of the first raw temperature data and the second raw temperature data; and using at least one of the first filtered decomposition terms of first order and higher and the second filtered decomposition terms of first order and higher to display a profile of temporal thermal gradient values on a graph of wellbore depth vs. time; and identifying the reaction of the fluid with the formation from the profile of temporal thermal gradient.

12. The non-transitory computer-readable medium of claim 11, wherein the method further comprises using the profile of temporal thermal gradient to determine at least one of: (i) a wellbore operation; (ii) a geologic event; (iii) a well integrity issue; (iv) a flow assurance problem; and (v) a status of downhole flow control devices.

13. The non-transitory computer-readable medium of claim 11 wherein the first and second raw temperature data further comprises spatio-temporal temperature measurements obtained over a selected depth interval of the wellbore.

14. The non-transitory computer-readable medium of claim 11, wherein the first decomposition terms of first order and higher and the second decomposition terms of first order and higher represent at least one of: a gradient of temperature versus depth; and a gradient of temperature versus time; a variance of temperature with respect to depth; a variance of temperature with respect to time; and a variance of temperature with respect to both depth and time.

* * * * *